US010473341B2

(12) United States Patent
Furuta et al.

(10) Patent No.: US 10,473,341 B2
(45) Date of Patent: Nov. 12, 2019

(54) INDOOR UNIT AND REFRIGERATION CYCLE APPARATUS

(71) Applicant: Mitsubishi Electric Corporation, Tokyo (JP)

(72) Inventors: Tatsuo Furuta, Tokyo (JP); Takaaki Takishita, Tokyo (JP); Naoya Matsunaga, Tokyo (JP); Takahiro Komatsu, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 0 days.

(21) Appl. No.: 15/522,948

(22) PCT Filed: Jan. 22, 2015

(86) PCT No.: PCT/JP2015/051616
§ 371 (c)(1),
(2) Date: Apr. 28, 2017

(87) PCT Pub. No.: WO2016/117065
PCT Pub. Date: Jul. 28, 2016

(65) Prior Publication Data

US 2017/0328580 A1 Nov. 16, 2017

(51) Int. Cl.
*F24F 1/0014* (2019.01)
*F24F 1/0047* (2019.01)
(Continued)

(52) U.S. Cl.
CPC ..... *F24F 1/0014* (2013.01); *F24F 1/00* (2013.01); *F24F 1/0047* (2019.02); *F24F 1/22* (2013.01);
(Continued)

(58) Field of Classification Search
CPC ..... F24F 1/0014; F24F 13/224; F24F 1/0007; F24F 1/32; F24F 1/22; F24F 13/20;
(Continued)

(56) References Cited

U.S. PATENT DOCUMENTS

2008/0047281 A1* 2/2008 Fukushima ..... F24F 1/0007 62/78
2011/0240255 A1* 10/2011 Sakashita ..... F24F 1/0007 165/53

FOREIGN PATENT DOCUMENTS

AU 2014260970 B2 * 3/2014
EP 1953463 A1 8/2008
(Continued)

OTHER PUBLICATIONS

Office Action dated Oct. 31, 2017 issued in corresponding JP patent application No. 2016-570408 (and English translation).
(Continued)

*Primary Examiner* — Emmanuel E Duke
(74) *Attorney, Agent, or Firm* — Posz Law Group, PLC

(57) ABSTRACT

An indoor unit includes a main unit including an air inlet through which air enters from a room and an air outlet through which air blows into the room, an electrical component box mounted on an outer surface of the main unit and accommodating an electrical device, a refrigerant pipe connection portion to which a refrigerant pipe through which refrigerant passes is connected, a drain pipe connection portion to which a drain pipe through which drain water discharged from the main unit passes is connected, and an installation bolt attachment bracket mounted on the outer surface of the main unit and fixing the main unit to an installation bolt suspended from above a ceiling. The indoor unit has the refrigerant pipe connection portion, the drain
(Continued)

pipe connection portion, and the electrical component box on the same mounting surface.

9 Claims, 4 Drawing Sheets

(51) Int. Cl.

| | |
|---|---|
| ***F24F 13/20*** | (2006.01) |
| ***F24F 1/00*** | (2019.01) |
| ***F24F 1/22*** | (2011.01) |
| ***F24F 13/22*** | (2006.01) |
| *F24F 13/32* | (2006.01) |
| *F24F 1/34* | (2011.01) |

(52) U.S. Cl.
CPC ..... *F24F 13/20* (2013.01); *F24F 13/224* (2013.01); *F24F 1/34* (2013.01); *F24F 13/22* (2013.01); *F24F 13/32* (2013.01)

(58) Field of Classification Search
CPC .. F24F 13/222; F24F 13/28; F24F 1/00; F24F 1/34; F24F 2001/0037; F24F 13/22; F24F 13/32
See application file for complete search history.

(56) References Cited

FOREIGN PATENT DOCUMENTS

| | | | | |
|---|---|---|---|---|
| EP | 2 017 544 | A1 | | 1/2009 | |
| EP | 2017544 | A1 | * | 1/2009 | ..... F24F 1/0007 |
| EP | 2 378 217 | A1 | | 10/2011 | |
| JP | S59-67717 | U | | 5/1984 | |
| JP | H11-173599 | A | | 6/1999 | |
| JP | H11-325503 | A | | 11/1999 | |
| JP | 2002-013756 | A | | 1/2002 | |
| JP | 2010-164294 | A | | 7/2010 | |
| JP | 4582818 | B2 | | 9/2010 | |
| JP | 2013-029281 | A | | 2/2013 | |
| JP | 2014-098514 | A | | 5/2014 | |
| JP | 2014-215014 | A | | 11/2014 | |
| JP | 2014215014 | A | * | 11/2014 | |
| JP | 2014215014 | A | * | 11/2014 | |

OTHER PUBLICATIONS

International Search Report of the International Searching Authority dated Apr. 21, 2015 for the corresponding International application No. PCT/JP2015/051616 (and English translation).
Extended European Search Report dated Jan. 26, 2017 for the corresponding EP patent application No. 15871291.9.
Office Action dated Mar. 6, 2018 issued in corresponding JP patent application No. 2016-570408 (and English translation).
Communication pursuant to Article 94(3) EPC dated Aug. 7, 2017 issued in corresponding EP application No. 15871291.9.
Office action dated Feb. 11, 2019 issued in corresponding CN patent application No. 201580060530.8 (and English translation thereof).
Office action dated Jul. 26, 2019 issued in corresponding CN patent application No. 201580060530.8 (and English translation thereof).

* cited by examiner

INDOOR UNIT AND REFRIGERATION CYCLE APPARATUS

CROSS REFERENCE TO RELATED APPLICATION

This application is a U.S. national stage application of International Application No. PCT/JP2015/051616, filed on Jan. 22, 2015, the contents of which are incorporated herein by reference.

TECHNICAL FIELD

The present invention relates to an indoor unit and other components of a refrigeration cycle apparatus such as an air-conditioning apparatus.

BACKGROUND

A ceiling cassette indoor unit has an air inlet for drawing air from the room and an air outlet for blowing air into the room, the air inlet and the air outlet are exposed to the interior of the room, and the ceiling cassette indoor unit is installed with its main body embedded in a ceiling (refer to Patent Literature 1, for example).

PATENT LITERATURE

Patent Literature 1: Japanese Unexamined Patent Application Publication No. 2010-164294

When the indoor unit described above is to be mounted on, for example, a system ceiling, a main unit of the indoor unit is mounted above a ceiling by suspending the indoor unit from above the ceiling or other ways before the ceiling is covered. Then, operations such as pipe work involving an insulation process of winding a heat insulating material around pipes and electrical wiring work involving connecting electrical devices by wiring are performed. After that, a decorative panel is attached to the main unit. The decorative panel is a part to be exposed to the interior of the room after the ceiling is covered.

In this way, the main unit is mounted above the ceiling before the operations, and thus the space for the operations is limited. For this reason, an indoor unit with a configuration that allows the operations to be easily performed has been desired.

SUMMARY

Under the circumstances, the present invention aims to provide an indoor unit and other components that allow the operations to be easily performed during the works.

An indoor unit according to the present invention includes a main unit including an air inlet through which air enters from a room and an air outlet through which air blows into the room, an electrical component box mounted on an outer surface of the main unit and accommodating an electrical device, a refrigerant pipe connection portion to which a refrigerant pipe through which refrigerant passes is connected, a drain pipe connection portion to which a drain pipe through which drain water discharged from the main unit passes is connected, and an installation bolt attachment bracket mounted on the outer surface of the main unit and fixing the main unit to an installation bolt suspended from above a ceiling. The indoor unit has the refrigerant pipe connection portion, the drain pipe connection portion, and the electrical component box on the same mounting surface, and when the main unit is seen from a side facing the mounting surface, the mounting surface is positioned closer to the side than a tip portion of the installation bolt attachment bracket.

In the indoor unit according to the present invention, the refrigerant pipe connection portion, the drain pipe connection portion, and the electrical component box are on the same mounting surface from the view of the operator, and the mounting surface is positioned closer to the operator than the tip portion of the installation bolt attachment bracket fixing the main unit, and thus the operator can clearly see a working space. In a case of a system ceiling, for example, electrical wiring work and pipe work can be easily performed by removing a ceiling plate next to a ceiling opening portion on which the main unit is mounted while installation bolt and the installation bolt attachment bracket do not obstruct the operations.

DETAILED DESCRIPTION

Figure 1:
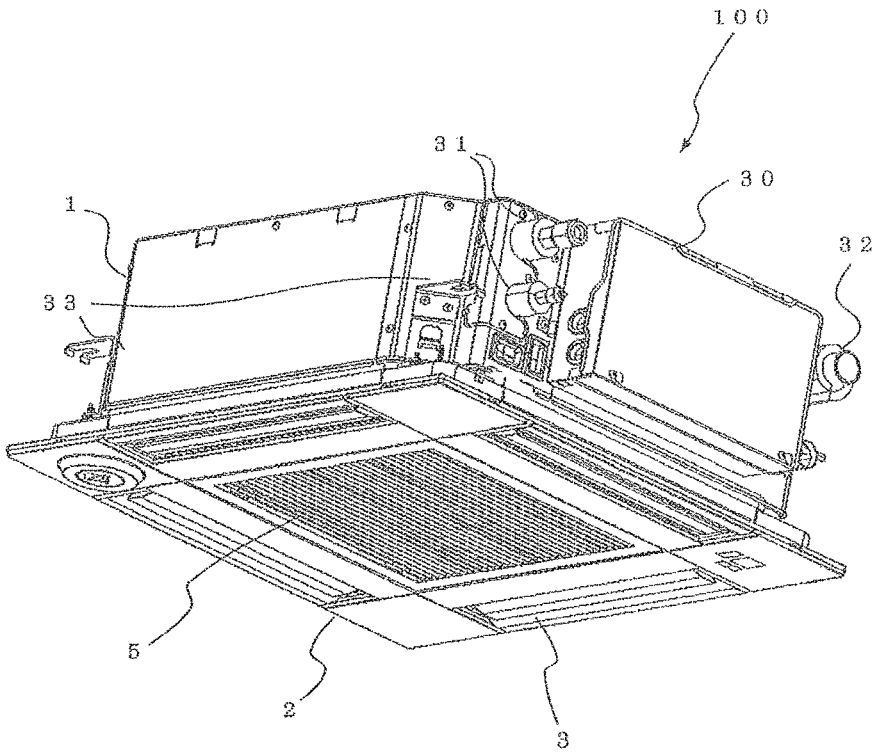
FIG. 1 is a view of an appearance of an indoor unit 100 in Embodiment 1 of the present invention.

Hereinafter, a description will be given mainly to an indoor unit according to embodiments of the present invention, with reference to the drawings. The same numerals in the drawings refer to the same or equivalent parts throughout the description of the embodiments illustrated below, and are common in the whole text of the embodiments. The forms of components herein are merely illustrative and are not intended to be limiting to the forms herein. In particular, combinations of the components are not limited to only the combinations in the respective embodiments, but a component described in any embodiment may be applied in another embodiment. In the description, the terms "topside" and "underside" respectively mean the upper side and the lower side in the figure. In the drawings, size relations between components may not be the actual size relations.

Embodiment 1

FIG. 1 is a view of an appearance of an indoor unit 100 in Embodiment 1 of the present invention. In Embodiment 1, a four-way cassette indoor unit 100 that can be embedded in the ceiling of a room and has air outlets 3 in four directions will be described as a representative example of the indoor unit. The indoor unit 100 is connected by pipes to an outdoor unit 200 that will be described later to form a refrigerant circuit to circulate refrigerant to perform refrigeration or air conditioning. Hereinafter, the indoor unit 100 included in an air-conditioning apparatus will be described.

A box-shaped main unit 1 of the indoor unit 100 includes a housing that has inside, for example, an indoor heat exchanger 110 as will be described later. All outer corners of the main unit 1 are chamfered to have inclined surfaces. A decorative panel 2 facing the indoor space and forming an exterior panel of the indoor unit 100 is attached to a lower part of the main unit 1. The decorative panel 2 has at the center thereof an air inlet grille 5 that forms an air inlet for drawing air from the room into the main unit 1. Also, on outer sides of the decorative panel 2, the air outlets 3 are provided each having an air direction control vane.

The indoor unit 100 of Embodiment 1 has, on an outer surface of the main unit 1, an electrical component box 30, refrigerant pipe connection portions 31, a drain pipe connection portion 32, and installation bolt attachment brackets 33. The electrical component box 30, the refrigerant pipe connection portions 31, and the drain pipe connection portion 32 are mounted especially on a side wall (a side surface) of the main unit 1 (the housing) for easy electrical and wiring works and maintenance. The electrical component box 30 is a box (a housing) accommodating electrical devices (electrical components) such as a drive circuit for driving a device in the indoor unit 100 (for example, a fan) and a controller for controlling actuation of the device. The controller is formed of a microprocessor unit, for example. Note that the controller is not limited to be formed of the microprocessor unit, but may be formed from an updatable program such as firmware, or may be formed of a program module executed by an instruction from a CPU. The refrigerant pipe connection portions 31 form connections between the indoor heat exchanger 110 inside the main unit 1 and refrigerant pipes. The refrigerant pipes include a gas refrigerant pipe 300 to pass gaseous (including a two-phase gas-liquid state) refrigerant and a liquid refrigerant pipe 400 to pass liquid (including a two-phase gas-liquid state) refrigerant. Thus, the main unit 1 of Embodiment 1 includes two refrigerant pipe connection portions 31. The drain pipe connection portion 32 forms a connection between a drain pipe to discharge drain water collected by a drain pan 7 to be described later to the outside of the indoor unit 100 and the drain pan 7 placed in the main unit 1.

Figure 2:
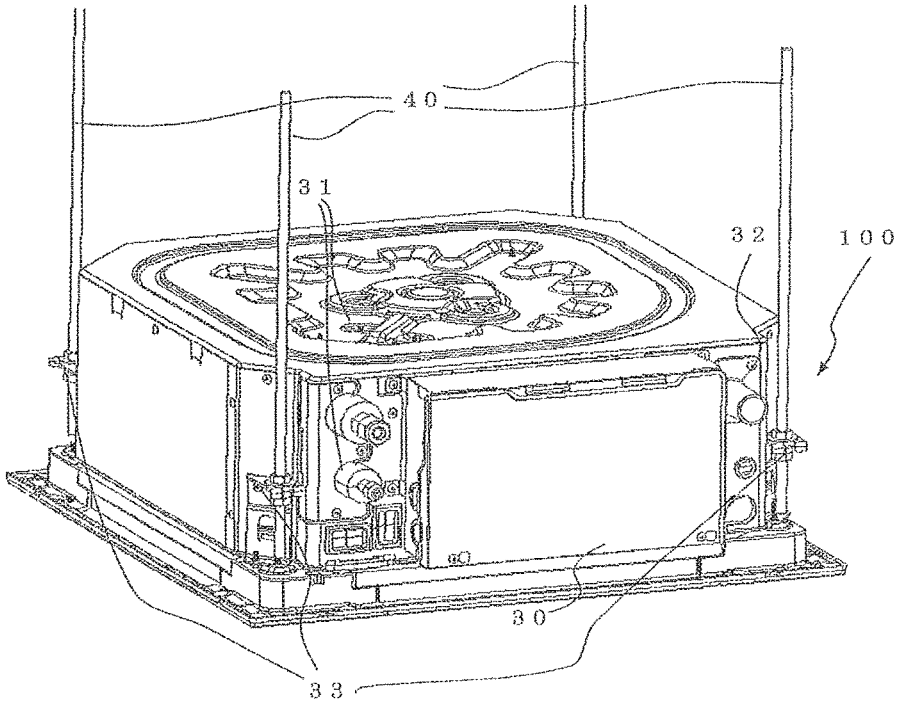
FIG. 2 is a perspective view of the indoor unit 100 according to Embodiment 1 of the present invention in which the indoor unit 100 is installed.

FIG. 2 is a perspective view of the indoor unit 100 according to Embodiment 1 of the present invention in which the indoor unit 100 is installed. The main unit 1 of the indoor unit 100 of Embodiment 1 has the installation bolt attachment brackets (suspension bracket) 33 on the chamfered and inclined surfaces formed on all the outer corners. Four installation bolts 40 are suspended from above the ceiling. When the main unit 1 is to be mounted above the ceiling, the installation bolt attachment brackets 33 and the installation bolts 40 are fastened together at given points to fix the main unit 1. The decorative panel 2 is attached to the main unit 1 from the indoor space side, and thus the indoor unit 100 can be mounted on the ceiling.

Figure 3:
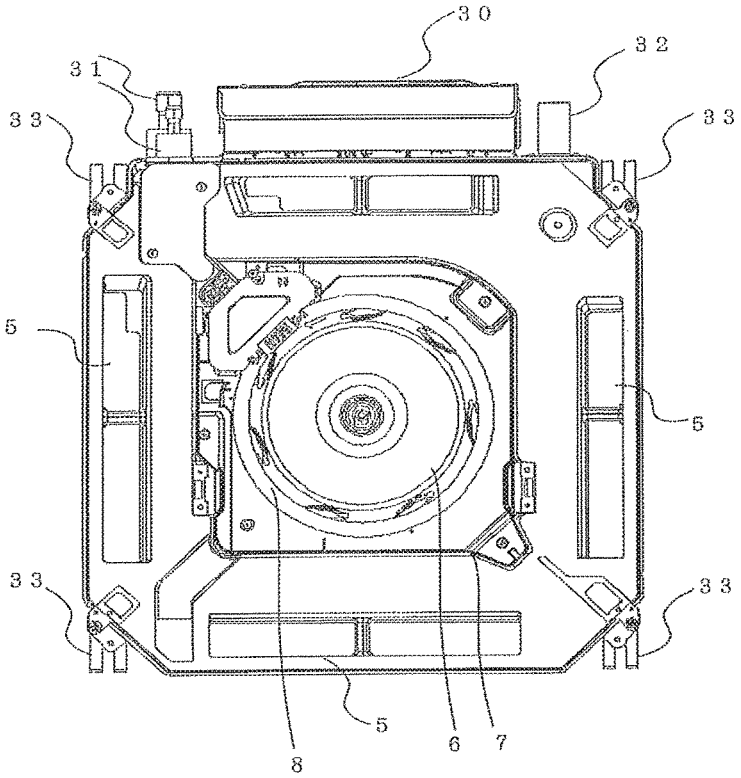
FIG. 3 is a view of a main unit 1 according to Embodiment 1 of the present invention as seen from an indoor space (a first figure).
Figure 4:
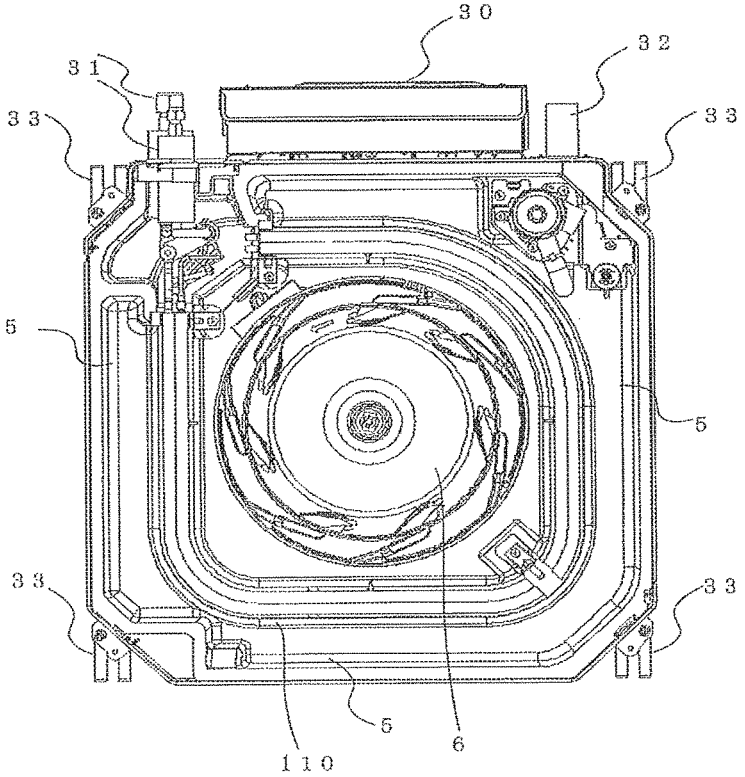
FIG. 4 is a view of the main unit 1 according to Embodiment 1 of the present invention as seen from the indoor space (a second figure).

FIGS. 3 and 4 are views of the main unit 1 according to Embodiment 1 of the present invention as seen from the indoor space (the lower side). FIG. 4 is a view of the main unit 1 in FIG. 3 with the drain pan 7 and a bell mouth 8 removed. The indoor unit 100 has a turbo fan 6 at the center of the inside of the main unit 1. Actuation of the turbo fan 6 forms an air passage from the air inlet through the inside of the main unit 1 to the air outlets 3. The drain pan 7 collects drain water generated on the indoor heat exchanger 110 arranged to surround the turbo fan 6. The bell mouth 8 rectifies the air having entered through the air inlet by the actuation of the turbo fan 6. The indoor heat exchanger 110 acts as an evaporator evaporating the refrigerant to cool down the room air during the cooling operation. On the other hand, the indoor heat exchanger 110 acts as a condenser condensing the refrigerant to heat the room air during the heating operation.

Figure 5:
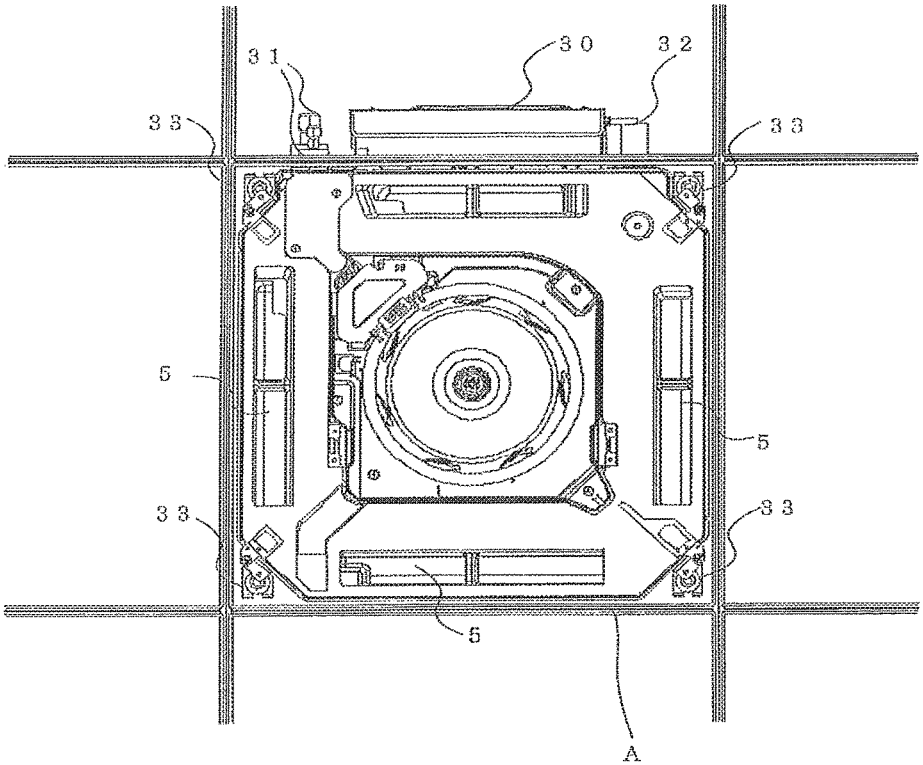
FIG. 5 is a view for explaining a size of the indoor unit 100 according to Embodiment 1 of the present invention.

FIG. 5 is a view for explaining a size of the indoor unit 100 according to Embodiment 1 of the present invention. For example, in the indoor unit 100 of Embodiment 1, a size of the main unit 1 is matched with a size of a ceiling frame A of the system ceiling, so that the main unit 1 can draw and blow the room air. When the air passage in the main unit 1 and other factors are taken into account, the size of the main unit 1 is preferably similar to the size of the ceiling frame A. In the indoor unit 100 of Embodiment 1, the electrical component box 30 is mounted on the outer side of the main unit 1 rather than on an inner side. Thus, the inner space of the main unit 1 including the passage for the air passing inside the main unit 1 can be further expanded. Wiring such as a signal wire connecting an electrical device in the electrical component box 30 and a device in the main unit 1 passes through a hole made on the main unit 1. The expanded inner space reduces bending of the wires, making the indoor unit more reliable. The inclined surfaces adjacent to the mounting surface to mount the electrical component box 30 are decreased more in width than those of the other inclined surfaces to increase the area of the mounting surface.

In the indoor unit 100 of Embodiment 1, the electrical component box 30, the refrigerant pipe connection portions 31, and the drain pipe connection portion 32 are mounted on the same surface. Also, tip portions of the installation bolt attachment brackets 33 attached to the inclined surfaces of the main unit 1 are made not to extend outwardly beyond the mounting surface of the electrical component box 30, the refrigerant pipe connection portions 31, and the drain pipe connection portion 32. Thus, the installation bolts 40 do not obstruct the operations during the pipe work and the electrical wiring work of the indoor unit 100, thereby performing the operations easily.

At this time, when the size of the main unit 1 is matched with the size of the ceiling frame A as in the indoor unit 100 of Embodiment 1, the overall size of the indoor unit 100 exceeds the dimensions of the ceiling frame A by mounting the electrical component box 30 onto the outer surface of the main unit 1. These devices, however, are mounted above the ceiling. Thus, it is only required that the lower surface of the main unit 1 fits in the ceiling frame A when the lower surface is seen upwardly from the indoor space.

As described above, in the indoor unit 100 of Embodiment 1, the electrical component box 30 is mounted on the outer surface of the main unit 1, and thus the air passage in the main unit 1 can be expanded. At this time, the refrigerant pipe connection portions 31, the drain pipe connection portion 32, and the electrical component box 30 are on the same mounting surface, and thus the working space for the electrical and wiring works can be concentrated.

Embodiment 2

Figure 6:
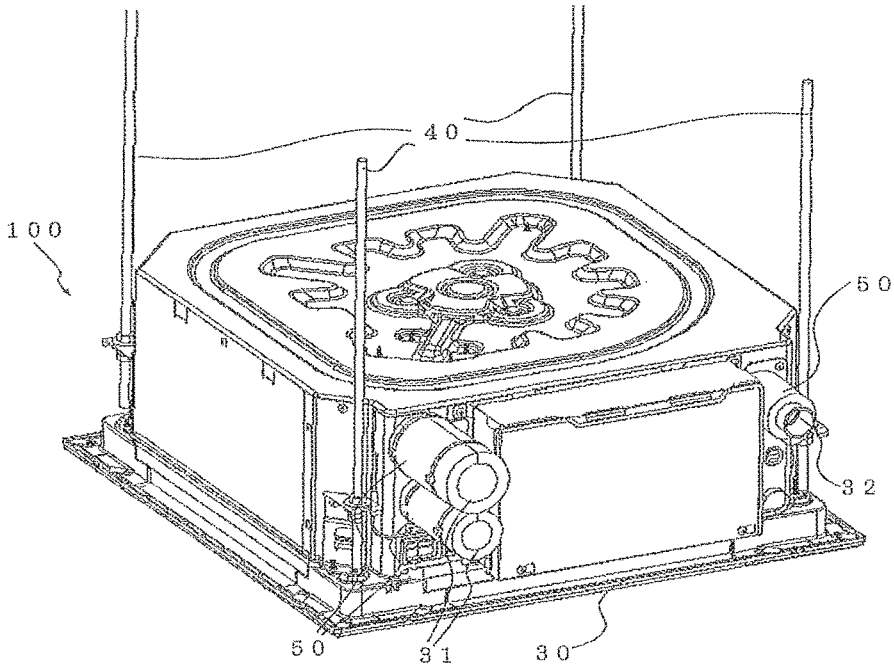
FIG. 6 is a view of a configuration of an indoor unit 100 according to Embodiment 2 of the present invention.

FIG. 6 is a view of a configuration of an indoor unit 100 according to Embodiment 2 of the present invention. The indoor unit 100 in FIG. 6 has a configuration similar to that described in Embodiment 1. In FIG. 6, a heat insulating material 50 covers the pipes for heat insulation and prevention of condensation on the pipes, for example.

Although a specific description is not given in Embodiment 1, an insulation process of covering the refrigerant pipes and the drain pipe with the heat insulating material 50 is performed in the pipe work. At this time, the refrigerant pipe connection portions 31 and the drain pipe connection portion 32 are also covered with the heat insulating material 50 for heat insulation.

In a conventional indoor unit, chamfered and inclined surface is wide, and thus the refrigerant pipe connection portions 31 and the drain pipe connection portion 32 are often mounted on the inclined surfaces. Thus, it is difficult to perform the operations in the insulation process of covering the heat insulating material 50. To address this problem, in Embodiment 2, the refrigerant pipe connection portions 31 and the drain pipe connection portion 32 are installed perpendicular to the mounting surface of the main unit 1. Thus, the need for the operations such as cutting the insulation process end surface of the heat insulating material 50 along the inclined surface is eliminated, making the operations in the insulation process of the pipe work easier. In addition, it is possible to easily cover the refrigerant pipe connection portions 31 and the drain pipe connection portion 32 with the heat insulating material 50 and also to prevent any portion of the refrigerant pipe connection portions 31 and the drain pipe connection portion 32 from being left uncovered.

Figure 7:
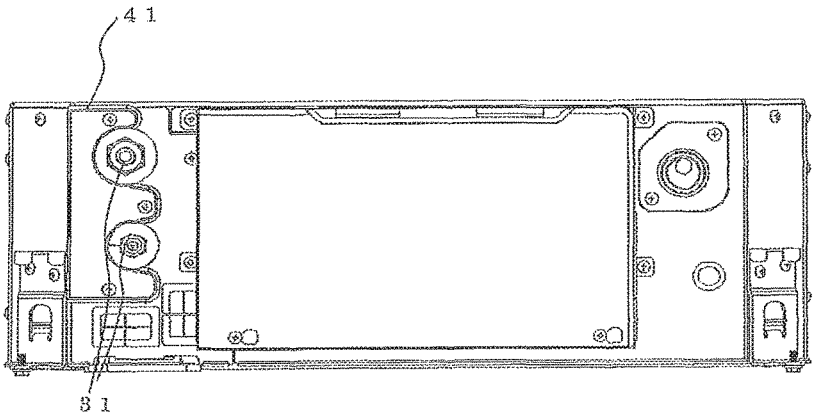
FIG. 7 is a view of a mounting surface of a main unit 1 of the indoor unit 100 according to Embodiment 2 of the present invention.

FIG. 7 is a view of the mounting surface of the main unit 1 of the indoor unit 100 according to Embodiment 2 of the present invention. In the indoor unit 100 of Embodiment 2, the refrigerant pipe connection portions 31 are caught in between the housing of the main unit 1 being the mounting surface and an attachment plate 41, and mounted with a part of the attachment plate 41 and a part of the housing overlapped with each other. Because the refrigerant pipe connection portions 31 are not mounted on the inclined surface in the indoor unit 100 of Embodiment 2, the refrigerant pipe connection portions 31 can be easily caught by the attachment plate 41. In addition, the part of the attachment plate 41 and the part of the housing are overlapped with each other as well as catching the refrigerant pipe connection portions 31 so that the attachment plate 41 and the housing can seal the refrigerant pipe connection portions 31 without any gaps at the end surfaces. Thus, air-conditioned air is prevented from leaking from the main unit 1.

As described above, in the indoor unit 100 according to Embodiment 2, the refrigerant pipe connection portions 31 and the drain pipe connection portion 32 are installed perpendicular to the mounting surface of the main unit 1, making it easier to perform the operations in the insulation process of the pipe work. Also, air-conditioned air is prevented from leaking into the ceiling space.

Embodiment 3

Figure 8:
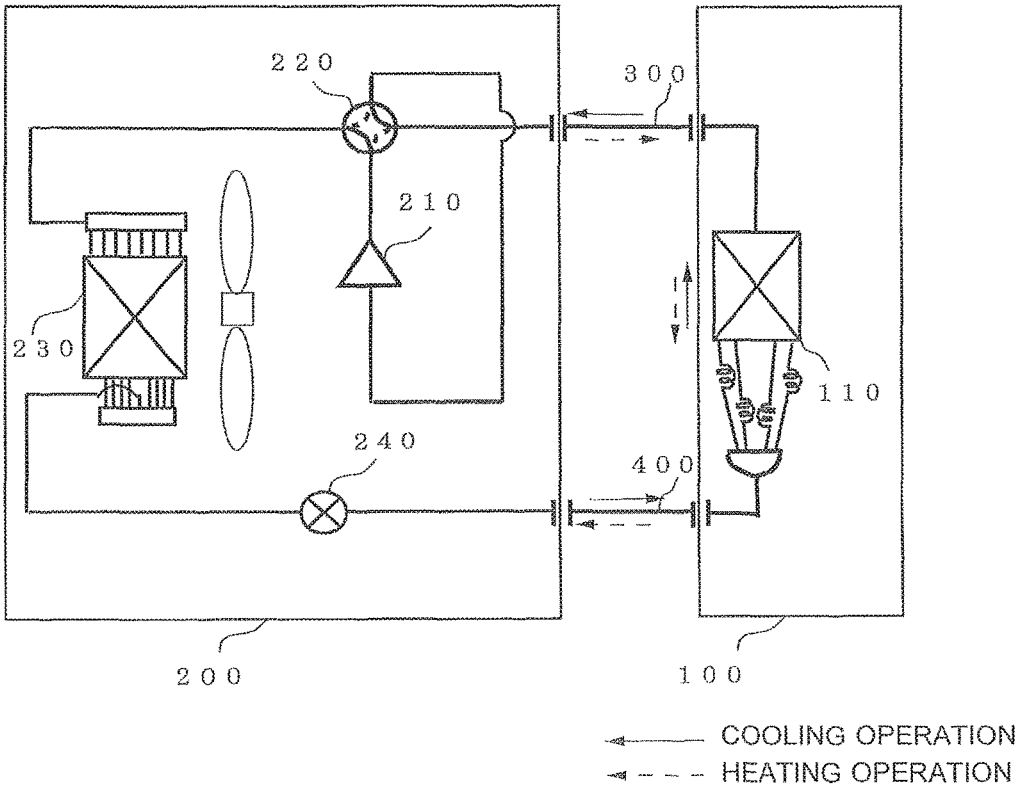
FIG. 8 is a view of a configuration example of an air-conditioning apparatus according to Embodiment 3 of the present invention.

FIG. 8 is a view of a configuration example of an air-conditioning apparatus according to Embodiment 3 of the present invention. In FIG. 8, the air-conditioning apparatus is shown as an example of a refrigeration cycle apparatus. In FIG. 8, components described in association with FIG. 1 or other figures are considered to operate similarly. In the air-conditioning apparatus in FIG. 8, an outdoor unit 200 is connected to the indoor unit 100 described in Embodiment 1 by the gas refrigerant pipe 300 and the liquid refrigerant pipe 400. The outdoor unit 200 includes a compressor 210, a four-way valve 220, an outdoor heat exchanger 230, and an expansion valve 240.

The compressor 210 compresses the suctioned refrigerant and discharges it. Although a specific limitation is not given, the capacity (an amount of refrigerant to be fed per unit time) of the compressor 210 may be varied by appropriately varying operating frequency, for example, using an inverter circuit. The four-way valve 220 switches the refrigerant flow between the cooling operation and the heating operation, for example.

The outdoor heat exchanger 230 in Embodiment 3 exchanges heat between the refrigerant and the air (outdoor air). For example, the outdoor heat exchanger 230 acts as an evaporator during the heating operation and evaporates the refrigerant to vaporize it. Also, the outdoor heat exchanger 230 acts as a condenser during the cooling operation and condenses the refrigerant to liquefy it.

The expansion valve 240 may be a throttling device (a flow control unit) and decompresses the refrigerant to expand it. For example, when the expansion valve 240 is an electronic expansion valve, the opening degree is adjusted based on an instruction from a controller (not shown) or other devices. The indoor heat exchanger 110 exchanges heat between the air to be air-conditioned and the refrigerant, for example. The indoor heat exchanger 110 acts as a condenser during the heating operation and condenses the refrigerant to liquefy it. Also, the indoor heat exchanger 110 acts as an evaporator during the cooling operation and evaporates the refrigerant to vaporize it.

An air-conditioning apparatus with the above configuration can achieve the heating and cooling operations by switching the refrigerant flow by means of the four-way valve 220 in the outdoor unit 200.

INDUSTRIAL APPLICABILITY

Although the above embodiments have described a four-way cassette indoor unit blowing air in four directions through the four air outlets 3 as the indoor unit 100, the indoor unit 100 is not limited to the configuration. For example, the present invention can be applied to other ceiling embedded indoor units corresponding to two- or three-direction air flow. Alternatively, the present invention can be applied to other types of indoor units, in addition to the ceiling embedded indoor units.

Although the above embodiments have described an air-conditioning apparatus as an example of the refrigeration cycle apparatus, the present invention is not limited to the configuration. For example, the present invention can be applied to other refrigeration cycle apparatuses such as a refrigerator and a freezer. Also, the present invention can be applied not only to the refrigeration cycle apparatus, but also to devices such as an air-sending device and a ventilating device.

The invention claimed is:

1. An indoor unit comprising: a main unit including an air inlet through which air enters from a room and an air outlet through which air blows into the room; an electrical component box mounted on an outer surface of the main unit and accommodating an electrical device; a refrigerant pipe connection portion to which a refrigerant pipe is connected and through which refrigerant passes; a drain pipe connection portion to which a drain pipe is connected and through which drain water is discharged from the main unit; an installation bolt attachment bracket mounted on the outer surface of the main unit and fixing the main unit to an installation bolt suspended from above a ceiling, and the indoor unit having the refrigerant pipe connection portion, the drain pipe connection portion, and the electrical component box on a same mounting surface and when the main unit is seen from a side facing the same mounting surface, the same mounting surface being positioned closer to the side than a tip portion of the installation bolt attachment bracket, wherein the drain pipe connection portion is mounted on the same mounting surface away from and outside of the electric component box, and wherein the indoor unit is embedded in the ceiling of the room and is of a four-way cassette structure having the air outlets in four directions and the air inlet, the air outlets and the air inlet facing an interior of the room.

2. The indoor unit of claim 1, wherein the refrigerant pipe connection portion is installed perpendicular to the same mounting surface.

3. The indoor unit of claim 1, wherein the drain pipe connection portion is installed perpendicular to the same mounting surface.

4. A refrigeration cycle apparatus comprising:

the indoor unit of claim 1; and an outdoor unit supplying heat to the indoor unit.

5. The indoor unit of claim 1, wherein the main unit is box-shaped with chamfered corners that includes an inclined side surface adjacent the same mounting surface, the installation bolt attachment bracket includes a tip portion extending outwardly from the inclined side surface of the main unit, the same mounting surface is a flat surface, and the tip portion of the installation bolt attachment bracket does not extend beyond a plane containing the flat surface of the same mounting surface.

6. An indoor unit comprising: a main unit including an air inlet through which air enters from a room and an air outlet through which air blows into the room; an electrical component box mounted on an outer surface of the main unit and accommodating an electrical device; a refrigerant pipe connection portion to which a refrigerant pipe is connected and through which refrigerant passes; a drain pipe connection portion to which a drain pipe is connected and through which drain water is discharged from the main unit; installation bolt attachment brackets mounted on the outer surface of the main unit and fixing the main unit to installation bolts suspended from above a ceiling, the installation bolt attachment brackets extending outwardly and perpendicularly from sides of the main unit, and a same mounting surface mounting the refrigerant pipe connection portion, the drain pipe connection portion and the electrical component; the same mounting surface being a planar surface extending parallel to the installation bolts and being located beyond tip portions of the installation bolt attachment brackets, wherein the drain pipe connection portion is mounted on the same mounting surface away from and outside of the electric component box, and wherein the indoor unit is embedded in the ceiling of the room, is a four-way cassette structure and has the air outlets facing in four directions and the air inlet, the air outlets and the air inlet facing an interior of the room.

7. The indoor unit of claim 6, wherein the refrigerant pipe connection portion is installed perpendicular to the same mounting surface.

8. The indoor unit of claim 6, wherein the drain pipe connection portion is installed perpendicular to the same mounting surface.

9. A refrigeration cycle apparatus comprising:

the indoor unit of claim 6; and an outdoor unit supplying heat to the indoor unit.

* * * * *